US010573259B2

(12) United States Patent
Park et al.

(10) Patent No.: US 10,573,259 B2
(45) Date of Patent: Feb. 25, 2020

(54) DISPLAY APPARATUS AND DRIVING METHOD THEREOF

(71) Applicant: Samsung Display Co., Ltd., Yongin-si, Gyeonggi-do (KR)

(72) Inventors: Sung Jae Park, Wonju-si (KR); Gi Geun Kim, Seoul (KR); Jae Sung Bae, Suwon-si (KR); Dong Hwa Shin, Yongin-si (KR); Kyung Su Lee, Hwaseong-si (KR); Jae-Gwan Jeon, Incheon (KR)

(73) Assignee: Samsung Display Co., Ltd. (KR)

( * ) Notice: Subject to any disclaimer, the term of this patent is extended or adjusted under 35 U.S.C. 154(b) by 0 days.

(21) Appl. No.: 15/816,322

(22) Filed: Nov. 17, 2017

(65) Prior Publication Data

US 2018/0144698 A1 May 24, 2018

(30) Foreign Application Priority Data

Nov. 18, 2016 (KR) ..... 10-2016-0153901

(51) Int. Cl.

| | |
|---|---|
| ***G09G 3/36*** | (2006.01) |
| ***G09G 3/20*** | (2006.01) |
| ***G09G 5/10*** | (2006.01) |

(52) U.S. Cl.

CPC ..... *G09G 3/3607* (2013.01); *G09G 3/3677* (2013.01); *G09G 3/3688* (2013.01); *G09G 2300/0452* (2013.01); *G09G 2310/08* (2013.01); *G09G 2320/0233* (2013.01); *G09G 2320/0285* (2013.01)

(58) Field of Classification Search

CPC ..... G09G 3/2044–2066; G09G 2320/0626; G09G 2320/0233; G09G 2320/0242; G09G 5/026; G09G 5/36; G09G 5/06; G09G 5/28; G09G 5/02; G09G 2310/0232

See application file for complete search history.

(56) References Cited

U.S. PATENT DOCUMENTS

2008/0272998 A1* 11/2008 Yano ..... G09G 3/2051 345/89
2016/0189601 A1* 6/2016 Jung ..... G09G 3/20 345/212
2018/0308413 A1* 10/2018 Jin ..... G09G 3/3607

FOREIGN PATENT DOCUMENTS

| | | |
|---|---|---|
| KR | 1020110066333 | 6/2011 |
| KR | 1020110130177 | 12/2011 |
| KR | 1020150025774 | 3/2015 |
| KR | 1020160011817 | 2/2016 |
| KR | 1020160081793 | 7/2016 |

OTHER PUBLICATIONS

European Search Report corresponding to EP Application No. 17202208.9, dated Mar. 23, 2018; 13 pages.

* cited by examiner

*Primary Examiner* — Xuemei Zheng
(74) *Attorney, Agent, or Firm* — Innovation Counsel LLP

(57) ABSTRACT

A display device according to an exemplary embodiment includes: a display panel including a display area which includes at least one non-quadrangle edge and a plurality of pixels; and a signal controller applying spatial-temporal division processing to an image signal corresponding to a first pixel which is not included in the non-quadrangle edge and bypassing the spatial-temporal division processing to an image signal corresponding to a second pixel which is included in the non-quadrangle edge.

21 Claims, 15 Drawing Sheets

FIG. 4A

| Pixel column number | n-3 | | | n-2 | | | n-1 | | | n | | |
|---|---|---|---|---|---|---|---|---|---|---|---|---|
| RD/GD/BD | 60 | 60 | 60 | 60 | 60 | 60 | 60 | 60 | 60 | 60 | 60 | 60 |
| CHS1-CHS3 | 1 | 0 | 1 | 0 | 1 | 0 | 1 | 0 | 1 | 0 | 1 | 0 |
| RS1/GS1/BS1 | **90** | | **90** | | **90** | | **90** | | **90** | | **90** | |
| RS2/GS2/BS2 | | **30** | | **30** | | **30** | | **30** | | **30** | | **30** |
| DATA | **90** | **30** | **90** | **30** | **90** | **30** | **90** | **30** | **90** | **30** | **90** | **30** |

FIG. 4B

| Pixel column number | n-3 | | | n-2 | | | n-1 | | | n | | |
|---|---|---|---|---|---|---|---|---|---|---|---|---|
| RD/GD/BD | 60 | 60 | 60 | 60 | 60 | 60 | 60 | 60 | 60 | 60 | 60 | 60 |
| CHS1-CHS3 | 0 | 1 | 0 | 1 | 0 | 1 | 0 | 1 | 0 | 1 | 0 | 1 |
| RS1/GS1/BS1 | | **90** | | **90** | | **90** | | **90** | | **90** | | **90** |
| RS2/GS2/BS2 | **30** | | **30** | | **30** | | **30** | | **30** | | **30** | |
| DATA | **30** | **90** | **30** | **90** | **30** | **90** | **30** | **90** | **30** | **90** | **30** | **90** |

FIG. 4C

| Pixel column number | n-3 | | | n-2 | | | n-1 | | | n | | |
|---|---|---|---|---|---|---|---|---|---|---|---|---|
| RD/GD/BD | 60 | 60 | 60 | 60 | 60 | 60 | 60 | 60 | 60 | 60 | 60 | 60 |
| CHS1-CHS3 | 1 | 0 | 1 | 0 | 1 | 0 | 1 | 0 | 1 | | | |
| RS1/GS1/BS1 | **90** | | **90** | | **90** | | **90** | | **90** | | | |
| RS2/GS2/BS2 | | **30** | | **30** | | **30** | | **30** | | | | |
| DATA | **90** | **30** | **90** | **30** | **90** | **30** | **90** | **30** | **90** | **60** | **60** | **60** |

FIG. 4D

| Pixel column number | n-3 | | | n-2 | | | n-1 | | | n | | |
|---|---|---|---|---|---|---|---|---|---|---|---|---|
| RD/GD/BD | 60 | 60 | 60 | 60 | 60 | 60 | 60 | 60 | 60 | 60 | 60 | 60 |
| CHS1-CHS3 | 0 | 1 | 0 | 1 | 0 | 1 | 0 | 1 | 0 | | | |
| RS1/GS1/BS1 | | **90** | | **90** | | **90** | | **90** | | | | |
| RS2/GS2/BS2 | **30** | | **30** | | **30** | | **30** | | **30** | | | |
| DATA | **30** | **90** | **30** | **90** | **30** | **90** | **30** | **90** | **30** | **60** | **60** | **60** |

FIG. 5A

| Pixel column number | n-3 | | | n-2 | | | n-1 | | | n | | |
|---|---|---|---|---|---|---|---|---|---|---|---|---|
| RD/GD/BD | 60 | 60 | 60 | 60 | 60 | 60 | 60 | 60 | 60 | 60 | 60 | 60 |
| CHS1-CHS3 | 1 | 0 | 1 | 0 | 1 | 0 | | | | | | |
| RS1/GS1/BS1 | 90 | | 90 | | 90 | | | | | | | |
| RS2/GS2/BS2 | | 30 | | 30 | | 30 | | | | | | |
| DATA | 90 | 30 | 90 | 30 | 90 | 30 | 60 | 60 | 60 | 60 | 60 | 60 |

FIG. 5B

| Pixel column number | n-3 | | | n-2 | | | n-1 | | | n | | |
|---|---|---|---|---|---|---|---|---|---|---|---|---|
| RD/GD/BD | 60 | 60 | 60 | 60 | 60 | 60 | 60 | 60 | 60 | 60 | 60 | 60 |
| CHS1-CHS3 | 0 | 1 | 0 | 1 | 0 | 1 | | | | | | |
| RS1/GS1/BS1 | | 90 | | 90 | | 90 | | | | | | |
| RS2/GS2/BS2 | 30 | | 30 | | 30 | | | | | | | |
| DATA | 30 | 90 | 30 | 90 | 30 | 90 | 60 | 60 | 60 | 60 | 60 | 60 |

FIG. 6A

| Pixel column number | n-3 | | | n-2 | | | n-1 | | | n | | |
|---|---|---|---|---|---|---|---|---|---|---|---|---|
| RD/GD/BD | 60 | 60 | 60 | 60 | 60 | 60 | 60 | 60 | 60 | 60 | 60 | 60 |
| CHS1-CHS3 | 1 | 0 | 1 | 0 | 1 | 0 | 1 | 0 | 1 | | | |
| RS1/GS1/BS1 | **90** | | **90** | | **90** | | **78** | | **78** | | | |
| RS2/GS2/BS2 | | **30** | | **30** | | **30** | | **42** | | | | |
| DATA | **90** | **30** | **90** | **30** | **90** | **30** | **78** | **42** | **78** | **60** | **60** | **60** |

FIG. 6B

| Pixel column number | n-3 | | | n-2 | | | n-1 | | | n | | |
|---|---|---|---|---|---|---|---|---|---|---|---|---|
| RD/GD/BD | 60 | 60 | 60 | 60 | 60 | 60 | 60 | 60 | 60 | 60 | 60 | 60 |
| CHS1-CHS3 | 0 | 1 | 0 | 1 | 0 | 1 | 0 | 1 | 0 | | | |
| RS1/GS1/BS1 | | **90** | | **90** | | **90** | | **78** | | | | |
| RS2/GS2/BS2 | **30** | | **30** | | **30** | | **42** | | **42** | | | |
| DATA | **30** | **90** | **30** | **90** | **30** | **90** | **42** | **78** | **42** | **60** | **60** | **60** |

DISPLAY APPARATUS AND DRIVING METHOD THEREOF

CROSS-REFERENCE TO RELATED APPLICATION

This application claims priority to and the benefit of Korean Patent Application No. 10-2016-0153901 filed in the Korean Intellectual Property Office on Nov. 18, 2016, the entire contents of which are incorporated herein by reference.

BACKGROUND (a) Technical Field

The present disclosure relates to a display device and a driving method thereof.

(b) Description of the Related Art

Recently, demand for a display device having a non-quadrangular display area has increased. The display device having the non-quadrangular display area having a predetermined shape may be used for a display of a wearable device (for example, an edge-type terminal such as a smartwatch), a glass-type terminal (a smart glass), a head mounted display (HMD), and a mobile cluster.

An overall shape of the non-quadrangular display area is quadrangular having rounded edges or a shape of which an inner angle of adjacent edges exceeds 90 degrees. Accordingly, in pixels disposed at the edge of the non-quadrangle portion, an intensity of emitted light decreases such that the edge of the non-quadrangle display is recognized as a step shape.

The above information disclosed in this Background section is only for enhancement of understanding of the background of the inventive concept and therefore it may contain information that does not form the prior art that is already known in this country to a person of ordinary skill in the art.

SUMMARY

A display device to solve the problem that the edge of the non-quadrangle is recognized as the step type and a driving method thereof are provided.

A display device according to an exemplary embodiment includes: a display panel including a display panel including a display area which includes at least one non-quadrangle edge and a plurality of pixels; and a signal controller configured to apply spatial-temporal division processing to an image signal corresponding to a first pixel which is not included in the non-quadrangle edge and bypass the spatial-temporal division processing to an image signal corresponding to a second pixel which is included in the non-quadrangle edge.

The signal controller may divide the image signal corresponding to the second pixel into gray data of sub-pixels configuring the second pixel.

The signal controller generates image data of a third pixel which is disposed adjacent to the second pixel by bypassing the spatial-temporal division processing of an image signal corresponding to a third pixel.

The signal controller may apply the spatial-temporal division processing by using a first weight value for the image signal corresponding to the first pixel and apply the spatial-temporal division processing by using a second weight value for an image signal corresponding to the third pixel adjacent to the second pixel among the plurality of pixels, and the second weight value may be smaller than the first weight value.

The signal controller may bypass the spatial-temporal division processing corresponding to the second pixel when an aperture ratio difference of the sub-pixels configuring the second pixel is a predetermined threshold value or more, and may apply the spatial-temporal division processing to an image signal corresponding to a fourth pixel when the position of the fourth pixel among the sub-pixels configuring the fourth pixel is smaller than the threshold value.

A first angle formed between a reference line which is a connection line connecting a virtual center point and the non-quadrangle edge and a connection line connecting the second pixel and the virtual center point and a second angle formed between the reference line and a connection connecting the fourth pixel and the virtual center point may be different from each other.

A display device according to another exemplary embodiment includes: a signal controller, a gate driver, a data driver, and a plurality of pixels connected to the gate driver and the data driver, the plurality of pixels including a plurality of edge pixels disposed at an edge region included in a non-quadrangle edge of a display area; and a plurality of center pixels disposed at a location that is not included in the non-quadrangle edge on the display area, wherein the signal controller configured to apply at least one among a temporal division driving, a spatial division driving, and a spatial-temporal division driving to an image signal corresponding to the plurality of center pixels and configured not to apply the temporal division driving, the spatial division driving, and the spatial-temporal division driving to an image signal corresponding to the plurality of edge pixel.

The display device may further include the signal controller configured to divide an input image signal into first to third gray data, apply spatial-temporal division processing for the first to third gray data to generate first to third correction gray data when the first to third gray data correspond to one among the plurality of center pixels, and bypass the spatial-temporal division processing for the first to third gray data when the first to third gray data correspond to one among the plurality of edge pixels.

The signal controller may arrange the bypass-processed first to third gray data and the first to third correction gray data depending on the location of the plurality of edge pixels and the plurality of center pixels.

The signal controller may include: an RGB classifier configured to receive information for a location of the plurality of pixels and determine whether or not applying the spatial-temporal division processing for the first to third gray data based on the information; and a demultiflexer to receive the first to third gray data of the plurality of center pixels from the RGB classifier and select a spatial-temporal division processing path respectively corresponding to the received first to third gray data, and generates the first to third correction gray data through the path selected by the demultiflexer.

The signal controller may further include: a first gamma controller configured to multiply a weight value corresponding to the received first to third gray data to the first to third gray data received from the demultiflexer to generate compensation gray data and add the compensation gray data to the received first to third gray data to generate correction gray data; and a second gamma controller configured to multiply a weight value corresponding to the received first to third gray data to the first to third gray data received from the demultiflexer to generate compensation gray data and subtract the compensation gray data from the received first to third gray data to generate correction gray data.

The signal controller may further include a generator generating image data. The demultiflexer may receive the first to third gray data from the RGB classifier, the generator receives at least one among the first to third correction gray data from the first gamma controller, receive the rest among the first to third correction gray data from the second gamma controller, and generate the image data according to the location of the plurality of edge pixels based on the received first to third correction gray data.

The signal controller may bypass the first to third gray data corresponding to the plurality of center pixels to a generator which generates image data when the location of the plurality of center pixels among the plurality of pixels is disposed adjacent to one among the plurality of edge pixels.

The signal controller may spatial-temporal division processing by using a first weight value for the first to third gray data corresponding to the plurality of edge pixels among the plurality of pixels, and applies the spatial-temporal division processing by using a second weight value for the first to third gray data corresponding to a third pixel adjacent to an edge pixel among the plurality of pixels, and the second weight value is smaller than the first weight value.

The signal controller may bypass-processes the first to third gray data corresponding to a first edge pixel when an aperture ratio difference between sub-pixels configuring the first edge pixel among the plurality of edge pixels is a predetermined threshold value or more, and applies the spatial-temporal division processing for the first to third gray data corresponding to a second edge pixel when the aperture ratio difference between the sub-pixels configuring the second edge pixel among the plurality of edge pixels is smaller than the threshold value.

A first angle formed between a reference line which is a connection line connecting a virtual center point and the non-quadrangle edge and a connection line connecting the second pixel and the virtual center point and a second angle formed between the reference line and a connection line connecting the fourth pixel and the virtual center point may be different from each other.

A method for driving a display device according to another exemplary embodiment includes: determining a location of a pixel corresponding to an input image signal; setting a first weight value for spatial-temporal division processing for gray data corresponding to a first pixel when the location of the first pixel is not included in the edge region; generating a first compensation gray data based on the predetermined first weight value and the gray data corresponding to the first pixel and generating image data based on the gray data corresponding to the first pixel and the first compensation gray data; and bypassing the spatial-temporal division processing for the gray data of a second pixel when a location of the second pixel is included in the edge region.

The method may further include bypassing the spatial-temporal division processing for the gray data corresponding to a third pixel when a location of the third pixel is adjacent to the second pixel.

The method may further include setting a second weight value for spatial-temporal division processing for the gray data corresponding to a third pixel when a location of the third pixel is adjacent to the second pixel, and the second weight value may be smaller than the first weight value.

The method may further include: comparing an aperture ratio difference between sub-pixels configuring the second pixel with a predetermined threshold value; bypassing the gray data corresponding to the second pixel when the aperture ratio difference is the predetermined threshold value or more; and applying spatial-temporal division processing for the gray data corresponding to the second pixel when the aperture ratio difference is smaller than the threshold value.

The aperture ratio difference may be changed depending on an angle between a reference line which is a connection line connecting a virtual center point and a non-quadrangle edge and a line connecting the virtual center point and the second pixel.

Through the exemplary embodiments, the display device and the driving method thereof for solving the problem that the non-quadrangle edge is recognized as a step type are provided.

BRIEF DESCRIPTION OF THE DRAWINGS

FIG. 4A is a view showing a part of gray data, correction gray data, and image data corresponding to pixels from (n−3)-th to n-th columns without an edge pixel in an i-th frame.

FIG. 4B is a view showing a part of gray data, correction gray data, and image data corresponding to pixels from (n−3)-th to n-th columns without an edge pixel in an (i+1)-th frame.

FIG. 4C is a view showing a part of gray data, correction gray data, and image data corresponding to pixels from (n−3)-th to (n−1)-th columns without an edge pixel and a n-th pixel of an edge pixel in an i-th frame.

FIG. 4D is a view showing a part of gray data, correction gray data, and image data corresponding to pixels from (n−3)-th to (n−1)-th columns without an edge pixel and an n-th pixel of an edge pixel in an (i+1)-th frame.

FIG. 5A is a view showing a part of gray data, correction gray data, and image data corresponding to pixels from (n−3)-th to (n−1)-th columns without an edge pixel and an n-th pixel of an edge pixel in an i-th frame according to another exemplary embodiment.

FIG. 5B is a view showing a part of gray data, correction gray data, and image data corresponding to pixels from (n−3)-th to (n−1)-th columns without an edge pixel and an n-th pixel of an edge pixel in an (i+1)-th frame according to another exemplary embodiment.

FIG. 6A is a view showing a part of gray data, correction gray data, and image data corresponding to pixels from (n−3)-th to (n−1)-th columns without an edge pixel and an n-th pixel of an edge pixel in an i-th frame according to another exemplary embodiment.

FIG. 6B is a view showing a part of gray data, correction gray data, and image data corresponding to pixels from an (n−3)-th to (n−1)-th columns without an edge pixel and an n-th pixel of an edge pixel in an (i+1)-th frame according to another exemplary embodiment.

DETAILED DESCRIPTION OF THE EMBODIMENTS

Figure 1:
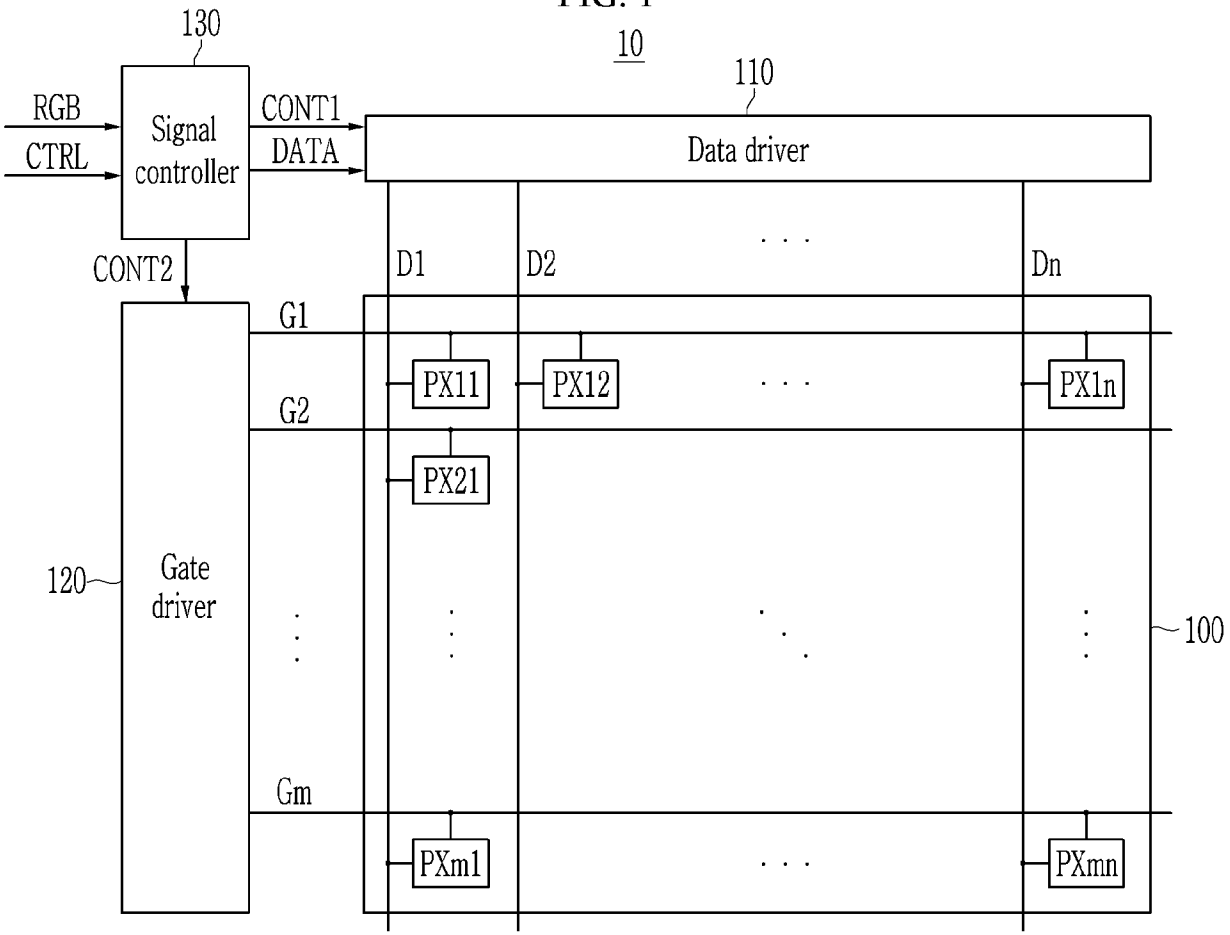
FIG. 1 is a block diagram schematically showing a display device according to an exemplary embodiment.

The present inventive concept will be described more fully hereinafter with reference to the accompanying drawings, in which exemplary embodiments of the inventive concept are shown. As those skilled in the art would realize, the described embodiments may be modified in various different ways, all without departing from the spirit or scope of the present inventive concept.

Accordingly, the drawings and description are to be regarded as illustrative in nature and not restrictive. Like reference numerals designate like elements throughout the specification.

In addition, unless explicitly described to the contrary, the word "comprise" and variations such as "comprises" or "comprising" will be understood to imply the inclusion of stated elements but not the exclusion of any other elements.

FIG. 1 is a block diagram schematically showing a display device according to an exemplary embodiment.

As shown, the display device 10 includes a display panel 100, a data driver 110, a gate driver 120, and a signal controller 130.

The display panel 100 includes a plurality of display signal lines and a plurality of pixels PX11-PXmn connected thereto. The display signal lines includes a plurality of gate lines G1-Gm transmitting a gate signal (referred to as "a scanning signal") and a plurality of data lines D1-Dn transmitting a data signal. The plurality of pixels PX11-PXmn may be respectively connected to the corresponding gate lines G1-Gm and data lines D1-Dn. The plurality of pixels PX11-PXmn may include a liquid crystal element or an organic light emitting diode. Hereinafter, it is assumed that the display device 10 is a liquid crystal display in which the plurality of pixels PX11-PXmn include the liquid crystal element and transmittance of the liquid crystal element is controlled depending on the data signal applied to each pixel.

The data driver 110 divides a gray reference voltage from a gray voltage generator (not shown) to generate a gray voltage for all grays or receives a plurality of gray voltages from the gray voltage generator. The data driver 110 is connected to the data lines D1-Dn of the display panel 100, and applies a plurality of data voltages to the data lines D1-Dn.

The data driver 110 receives image data DATA for pixels of one row depending on a data control signal CONT1 and converts the image data DATA into a data voltage by selecting a gray voltage corresponding to each image data DATA from the gray voltages, and then applies the data voltage to the corresponding data lines D1-Dn.

The gate driver 120 is connected to the gate lines G1-Gm to apply a gate signal having a gate-on voltage and a gate-off voltage to the gate lines G1-Gm.

The gate driver 120 applies the gate-on voltage to the gate lines G1-Gm depending on a gate control signal CONT2 from the signal controller 130. Thus, the data voltage applied to the data lines D1-Dn may be applied to the corresponding pixels.

Although not shown, a backlight may be positioned at a back side of the display panel 100 and may include at least one light source. As an example of the light source, a fluorescent lamp such as a CCFL (cold cathode fluorescent lamp) or an LED (light emitting diode) may be included.

The signal controller 130 generates the image data DATA, the data control signal CONT1, and the gate control signal CONT2 based on the image signal RGB and the control signal CTRL. The signal controller 130 may generate the image data DATA through one among temporal division processing, spatial division processing, and spatial-temporal division processing for the image signal RGB. The signal controller 130 may omit the temporal division processing, the spatial division processing, and the spatial-temporal division processing for the image signal RGB corresponding to the pixels included in an edge region (hereinafter, edge pixels) in which an aperture ratio between sub-pixels included in the pixel is different.

The temporal division processing is a data processing method in which one of a high gamma value and a low gamma value is applied to one frame among consecutive frames and the other of the high gamma value and the low gamma value is applied to the next frame.

The spatial division processing is a data processing method in which one of the high gamma value and the low gamma value is applied to one of two adjacent pixels and the other of the high gamma value and the low gamma value is applied to the other pixel.

The spatial-temporal division processing is a data processing method in which one of the high gamma value and the low gamma value is applied for the image signal RGB through temporal and spatial division. According to the spatial-temporal division processing, even with the same gray data, the data voltage applied to sub-pixels in different positions and emission timings may be differentiate.

Hereinafter, the signal controller 130 omitting the temporal division processing, the spatial division processing, and the spatial-temporal division processing for the pixels included in the edge region is referred to as bypass processing. Furthermore, in an exemplary embodiment, the display device according to the spatial-temporal division processing is described, however the present inventive concept is not limited thereto, and one of the temporal division processing and the spatial division processing may be applied.

Also, the signal controller 130 may correct the image signal RGB to compensate the aperture ratio difference between the sub-pixels of the edge pixel. For example, an aperture ratio deviation between the sub-pixels in the edge pixel may be reduced by changing the gray data of the image signal RGB inversely proportional to the aperture ratio of each sub-pixel of the edge pixel.

Also, the signal controller 130 may correct the image signal RGB of the pixels adjacent to the edge pixel in addition to the correction of the image signal RGB for the edge pixel. For example, the deviation of luminance between two pixels may be controlled by lowering the luminance of the adjacent sub-pixel having the same color with the edge pixel at a predetermined ratio.

The signal controller 130 receives the image signal RGB and the control signal CTRL that are input from the outside, for example, a graphic controller (not shown). The image signal RGB includes the gray data for each pixel of the display panel 100. When dividing a predetermined range of the luminance capable of being emitted by the pixel into grays of a predetermined number, for example, 1024, 256, or 128, the pixel may be emitted with the luminance of the gray depending on the gray data. The input control signal CTRL may include a vertical synchronization signal, a horizontal synchronizing signal, a main clock signal, and a data enable signal in relation to the image display.

The signal controller 130 may determine the data processing method depending on the position of the pixel corresponding to the image signal RGB according to the image signal RGB and the input control signal CTRL, may process the image signal RGB with the predetermined data processing method to generate the image data DATA, and may generate the data control signal CONT1 and the gate control signal CONT2 based on the input control signal CTRL. The data processing method may be one of the spatial-temporal division processing and the bypass processing.

The signal controller 130 may output the gate control signal CONT2 to the gate driver 120, and may output the data control signal CONT1 and the image data DATA to the data driver 110.

The data control signal CONT1 may include a horizontal synchronization start signal, a clock signal, and a line latch signal, and the gate control signal CONT2 may include a scanning start signal, an output enable signal, and a gate pulse signal.

The gate driver 120 sequentially applies the gate-on voltage to all gate lines G1-Gm during 1 horizontal period (referred to as "1H" and being the same as one period of the horizontal synchronizing signal and the data enable signal) based on the gate control signal CONT2, and the data driver 110 applies the plurality of data voltages to all pixels PX11-PXmn in synchronization with the gate-on voltage according to the data control signal CONT1.

Next, the display panel 100 of the display device 10 will be described with reference to FIG. 2.

Figure 2:
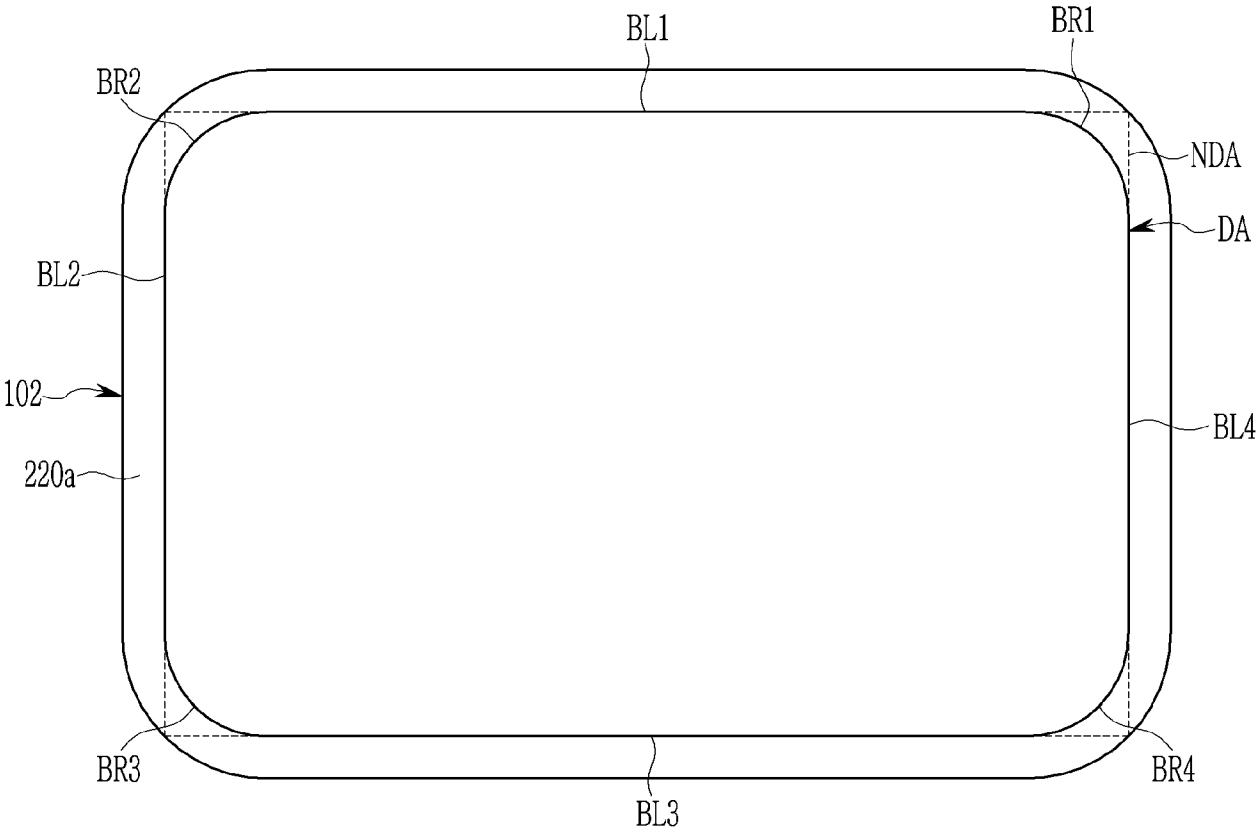
FIG. 2 is a top plan view schematically showing a display panel of a display device according to an exemplary embodiment.

FIG. 2 is a top plan view schematically showing a display panel of a display device according to an exemplary embodiment.

As shown in FIG. 2, the display panel 100 includes a display area DA having an overall quadrangle shape. The display area DA is a region defined by linear edges BL1, BL2, BL3, and BL4 and non-quadrangle edges BR1, BR2, BR3, and BR4.

In FIG. 2, the non-quadrangle edges BR1, BR2, BR3, and BR4 are shown to have a rounded shape, however the present inventive concept is not limited thereto. The non-quadrangle edges BR1, BR2, BR3, and BR4 may be connected to each other so that an inner angle between adjacent edges exceeds 90 degrees. Furthermore, four non-quadrangle edges BR1, BR2, BR3, and BR4 exist in the display area DA in FIG. 2, however the present inventive concept is not limited thereto. In the display area DA, there may be at least one non-quadrangle edge.

Hereinafter, it is described that the non-quadrangle edges BR1, BR2, BR3, and BR4 are edges with a rounded shape.

The display panel 100 may include a first substrate 102 in which the plurality of pixels are disposed and a light blocking member 220*a* disposed at the edge of the first substrate 102. The first substrate 102 may have a shape corresponding to the shape of the display area DA. For example, the first substrate 102 may be larger than the display area DA by a predetermined width from edges of the display area, four linear edges BL1, BL2, BL3, and BL4 and the non-quadrangle edges BR1, BR2, BR3, and BR4. However, the present inventive concept is not limited thereto, and the first substrate 102 may have the rectangular shape including the display area DA.

The light blocking member 220*a* may also be disposed on a non-display area NDA where the pixel emitting the light depending on the data signal so that the display area DA has the edge of the rounded shape. The light blocking member 220*a* is made of a light blocking material, thereby blocking light. The edge pixel according to the exemplary embodiment is the pixel disposed at the edge region included in the non-quadrangle edges BR1, BR2, BR3, and BR4.

In FIG. 2, it is described that the light blocking member 220*a* is disposed on the plurality of pixels to realize the edge of the rounded shape, however the edge of the rounded shape of the display area DA may be realized by controlling the pixel number, the size of each pixel, the shape of each pixel, etc. along with the edge.

Also, the display panel 100 may be a flexible display panel. Further, the display panel 100 may be a curved display panel having a curved surface.

Next, a configuration and a method thereof for generating the image data DATA based on the image signal RGB through the signal controller 130 according to an exemplary embodiment will be described with reference to FIG. 3.

Figure 3:
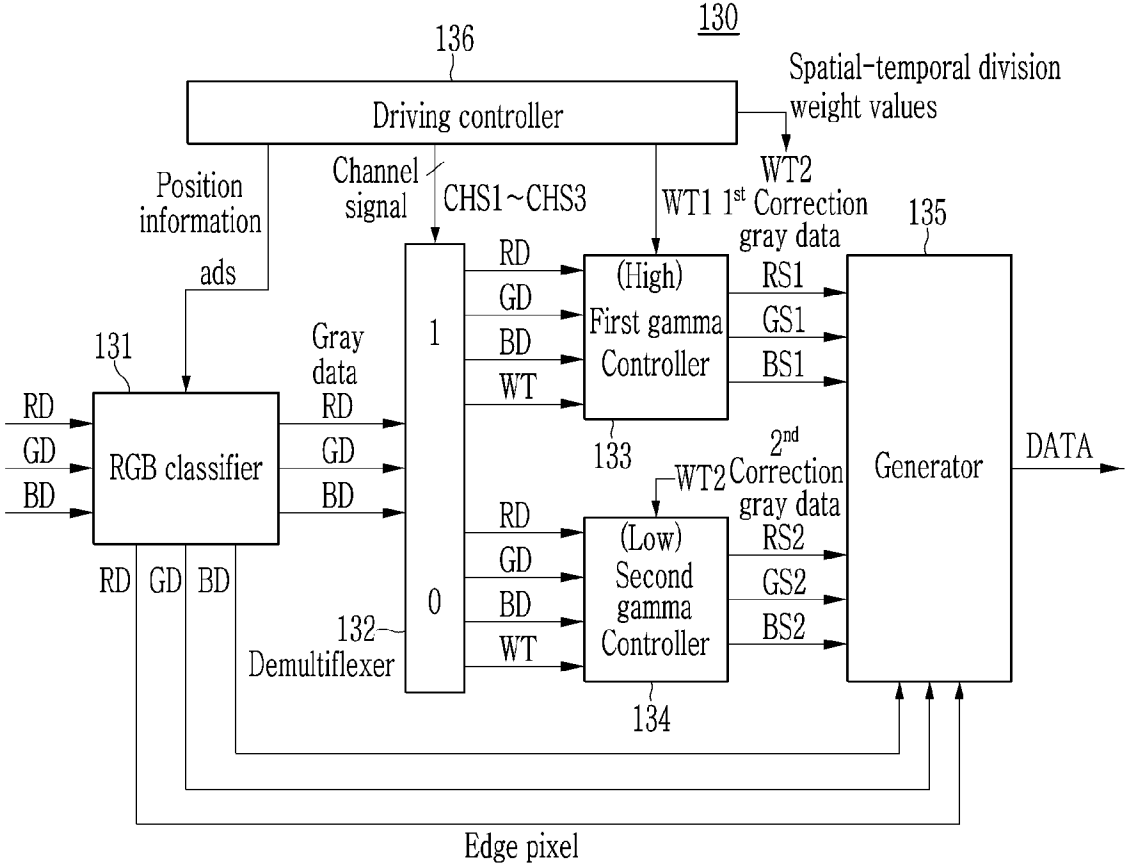
FIG. 3 is a block diagram showing a part of a signal controller according to an exemplary embodiment.

FIG. 3 is a block diagram showing a part of a signal controller according to an exemplary embodiment.

The signal controller 130 classifies the image signal RGB by red gray data RD, green gray data GD, and blue gray data BD, determines the data processing method depending on the location of the pixel corresponding to the gray data RD, GD, and BD, and processes and arranges the gray data RD, GD, and BD according to the data processing method to generate the image data DATA.

The signal controller 130 includes an RGB classifier 131, a demultiflexer 132, a first gamma controller 133, a second gamma controller 134, a generator 135, and a driving controller 136.

The driving controller 136 may generate position information (ads) for the position of the pixel corresponding to the gray data RD, GD, and BD, may generate channel signals CHS1-CHS3 selecting one among the first and second gamma controller s 133 and 134, and may generate spatial-temporal division weight values WT1 and WT2. The driving controller 136 is synchronized with the gray data RD, GD, and BD input to the RGB classifier 131, thereby transmitting the position information (ads) to the RGB classifier 131, the channel signals CHS1-CH3 to the demultiflexer 132, and the spatial-temporal division weight values WT1 and WT2.

The driving controller 136 may generate the channel signals CHS1-CHS3 and the spatial-temporal division weight values WT1 and WT2 only in the case that the position of the pixel is not the edge region. However, the present inventive concept is not limited thereto, and the channel signals CHS1-CHS3 and the spatial-temporal division weight value WT1 and WT2 may be generated for the edge pixel in another exemplary embodiment that is described later.

Also, in the exemplary embodiment, the RGB classifier 131 and the driving controller 136 are described as separate elements, however the present inventive concept is not limited thereto, and they may be formed of one element.

The RGB classifier 131 receives the position information (ads), transmits the gray data RD, GD, and BD to the generator 135 based on the position information (ads) when the gray data RD, GD, and BD are the gray data of the edge pixel, and transmits the gray data RD, GD, and BD to the demultiflexer 132 when the gray data RD, GD, and BD are not the gray data of the edge pixel. The RGB classifier 131 may include a table storing whether the pixel is the edge pixel or not according to the position information (ads) of the pixel.

The demultiflexer 132 selects and transmits a spatial-temporal division processing path respectively corresponding to the gray data RD, GD, and BD. The spatial-temporal division processing path according to the exemplary embodiment may include a path having a high gamma value and a path having a low gamma value.

For example, the demultiflexer 132 selects each spatial-temporal division processing path of the gray data RD, GD, and BD according to the channel signals CHS1-CHS3, and transmits it to one of the first gamma controller 133 and the second gamma controller 134 according to the selected path. In the exemplary embodiment, it is described that the gray data RD, GD, and BD are respectively input to the demultiflexer 132 in parallel such that a number of the channel signals CHS1-CHS3 is three.

For example, the demultiflexer 132 may transmit the red gray data RD to the first gamma controller 133 when the channel signal CHS1 is a logic level "1", and may transmit the red gray data RD to the second gamma controller 134 when the channel signal CHS1 is a logic level "0". The demultiflexer 132 may transmit the green gray data GD to the first gamma controller 133 when the channel signal CHS2 is the logic level "1", and may transmit the green gray data GD to the second gamma controller 134 when the channel signal CHS2 is the logic level "0". The demultiflexer 132 may transmit the blue gray data BD to the first gamma controller 133 when the channel signal CHS3 is the logic level "1", and may transmit the blue gray data BD to the second gamma controller 134 when the channel signal CHS3 is the logic level "0".

However, it is not limited thereto, and when the gray data RD, GD, and BD are input to the demultiflexer 132 in series, the demultiflexer 132 may transmit the gray data RD, GD, and BD to one of the first gamma controller 133 and the second gamma controller 134 depending on one channel signal. In this case, the channel signal may be synchronized with each of the gray data RD, GD, and BD that is input in series, and may have a frequency of at least three times higher than the frequency of the channel signals when the gray data RD, GD, and BD are input in parallel.

The first gamma controller 133 generates first correction gray data RS1, GS1, and BS1 to follow a high gamma curve defined by the high gamma value for the input gray data RD, GD, and BD.

For example, the first gamma controller 133 adds the compensation gray data for the spatial-temporal division processing to the gray data RD, GD, and BD to generate first correction gray data RS1, GS1, and BS1. The first gamma controller 133 may multiply the gray data RD, GD, and BD by the weight value WT1 to generate the compensation gray data.

The second gamma controller 134 generates second correction gray data RS2, GS2, and BS2 to follow a low gamma curve defined by the low gamma value for the input gray data RD, GD, and BD.

For example, the second gamma controller 134 subtracts the compensation gray data for the spatial-temporal division processing from the gray data RD, GD, and BD to generate second correction gray data RS2, GS2, and BS2. The second gamma controller 134 may multiply the gray data RD, GD, and BD by the weight value WT2 to generate the compensation gray data.

The generator 135 generates the first correction gray data RS1, GS1, and BS1, the second correction gray data RS2, GS2, and BS2, and the gray data RD, GD, and BD according to the positions of the pixel and the edge pixel to generate the image data DATA.

Next, an operation of the signal controller 130 will be described with reference to FIGS. 4A-4D. For convenience of description, the gray data RD, GD, and BD shown in FIGS. 4A-4D represent values of a 60 gray, and it is assumed the weight values WT1 and WT2 are 0.5. This is merely an example for explanation, and the inventive concept is not limited thereto.

FIG. 4A is a view showing a part of gray data, correction gray data, and image data corresponding to pixels from (n−3)-th to n-th columns without an edge pixel in an i-th frame.

FIG. 4B is a view showing a part of gray data, correction gray data, and image data corresponding to pixels from (n−3)-th to n-th columns without an edge pixel in an (i+1)-th frame.

In FIG. 4A and FIG. 4B, since the pixels from the (n−3)-th to the n-th columns are not the edge pixels, each of the gray data RD, GD, and BD is converted into one of a first correction gray data and a second correction gray data according to the spatial-temporal division processing.

As shown in FIG. 4A, because the channel signal CHS1 corresponding to the (n−3)-th red gray data RD is the logic level "1", the first correction gray data RS1 is generated into "90" by adding the compensation gray data "30" (60*0.5) to "60" of the red gray data RD. Because the channel signal CHS2 corresponding to the (n−3)-th green gray data GD is the logic level "0", the second correction gray data GS2 is generated into "30" by subtracting the compensation gray data "30" (60*0.5) from "60" of the green gray data GD. Because the channel signal CHS3 corresponding to the (n−3)-th blue gray data BD is the logic level "1", the first correction gray data BS1 is generated into "90" by adding the compensation gray data "30" (60*0.5) to "60" of the blue gray data BD.

Because the channel signal CHS1 corresponding to the (n−2)-th red gray data RD is the logic level "0", the second correction gray data RS2 is generated into "30" by subtracting the compensation gray data "30" (60*0.5) from "60" of the red gray data RD. Because the channel signal CHS2 corresponding to the (n−2)-th green gray data GD is the logic level "1", the first correction gray data GS1 is generated into "90" by adding the compensation gray data "30" (60*0.5) to "60" of the green gray data GD. Because the channel signal CHS3 corresponding to the (n−2)-th blue gray data BD is the logic level "0", the second correction gray data BS2 is generated into "30" by subtracting the compensation gray data "30" (60*0.5) from "60" of the blue gray data BD.

By this method, the first correction gray data RS1 and BS1 corresponding to the (n−1)-th pixel column is generated into 90, and the second correction gray data GS2 corresponding to the (n−1)-th pixel column is generated into 30. The first correction gray data GS1 corresponding to the n-th pixel column is generated into 90, and the second correction gray data RS2 and BS2 corresponding to the n-th pixel column is generated into 30.

The generator 135 generates the first correction gray data RS1, GS1, and BS1 and the second correction gray data RS2, GS2, and BS2 depending on the position to generate the image data DATA.

The logic level of the channel signals CHS1-CHS3 in the (i+1)-th frame shown in FIG. 4B is opposite to the logic level of the channel signals CHS1-CHS3 in the i-th frame. Accordingly, the first correction gray data RS1, GS1, and BS1 and the second correction gray data RS2, GS2, and BS2 of each of the pixels in the (i+1)-th frame respectively have the different values from the first correction gray data RS1, GS1, and BS1 and the second correction gray data RS2, GS2, and BS2 of the corresponding pixels.

In the exemplary embodiment, in two frames, an average of the first correction gray data RS1, GS1, and BS1 and the second correction gray data RS2, GS2, and BS2 of each of the pixels is the same as the gray data RD, GD, and BD.

FIG. 4C is a view showing a part of gray data, correction gray data, and image data corresponding to pixels from (n−3)-th to (n−1)-th columns without an edge pixel and an n-th pixel of an edge pixel in an i-th frame.

FIG. 4D is a view showing a part of gray data, correction gray data, and image data corresponding to pixels from (n−3)-th to (n−1)-th columns without an edge pixel and an n-th pixel of an edge pixel in an (i+1)-th frame.

In FIG. 4C and FIG. 4D, the method of generating the first correction gray data RS1, GS1, and BS1 and the second correction gray data RS2, GS2, and BS2 of the (n−3)-th to (n−1)-th pixels is the same as described above such that it is omitted.

As shown in FIG. 4C and FIG. 4D, in the i-th frame and the (i+1)-th frame, the gray data RD, GD, and BD of the n-th pixel is bypass-processed such that each of the gray data RD, GD, and BD is "60".

The generator 135 generates the gray data RD, GD, and BD, the first correction gray data RS1, GS1, and BS1, and the second correction gray data RS2, GS2, and BS2 depending on the position of the pixel to generate the image data DATA.

In the case of the spatial-temporal division processing for the gray data RD, GD, and BD of the pixel of the edge region, the edge region is displayed as the step shape. Accordingly, in the exemplary embodiment, the bypass processing is applied for the gray data RD, GD, and BD of the edge pixel without applying the spatial-temporal division processing.

When only the gray data RD, GD, and BD of the edge pixel is bypass-processed, the deviation of the luminance between the edge pixel and the adjacent pixels increases such that the edge pixel may be recognized. To improve this, the bypass processing may also be applied for the gray data RD, GD, and BD of the pixel adjacent to the edge pixel. Also, the weight values WT1 and WT2 of the spatial-temporal division processing may be altered for the gray data RD, GD, and BD of the pixel adjacent to the edge pixel. For example, the weight value of the adjacent pixel may be smaller than the weight value for the pixel that is not adjacent to the edge pixel.

FIG. 5A is a view showing a part of gray data, correction gray data, and image data corresponding to pixels from (n−3)-th to (n−1)-th columns without an edge pixel and an n-th pixel of an edge pixel in an i-th frame according to another exemplary embodiment.

FIG. 5B is a view showing a part of gray data, correction gray data, and image data corresponding to pixels from (n−3)-th to (n−1)-th columns without an edge pixel and an n-th pixel of an edge pixel in an (i+1)-th frame according to another exemplary embodiment.

As shown in FIG. 5A and FIG. 5B, the gray data RD, GD, and BD of the (n−1)-th pixel adjacent to the n-th edge pixel are bypass-processed.

FIG. 6A is a view showing a part of gray data, correction gray data, and image data corresponding to pixels from (n−3)-th to (n−1)-th columns without an edge pixel and an n-th pixel of an edge pixel in an i-th frame according to another exemplary embodiment.

FIG. 6B is a view showing a part of gray data, correction gray data, and image data corresponding to pixels from (n−3)-th to (n−1)-th columns without an edge pixel and an n-th pixel of an edge pixel in an (i+1)-th frame according to another exemplary embodiment.

In the other exemplary embodiment shown in FIG. 6A and FIG. 6B, it is described that the driving controller 136 sets the weight values WT1 and WT2 as "0.3" for the gray data RD, GD, and BD of the (n−1)-th pixel adjacent to the n-th edge pixel.

The compensation gray data is generated into "18" by applying the weight value WT1 "0.3" to the gray data RD, GD, and BD of "60". Accordingly, the compensation gray data is added to the gray data RD, GD, and BD by the first gamma controller 133 to generate the first correction gray data RS1, GS1, and BS1 into "78", and the compensation gray data is subtracted from the gray data RD, GD, and BD by the second gamma controller 134 to generate the second correction gray data RS2, GS2, and BS2 into "42".

The gray data RD, GD, and BD of the n-th edge pixel is bypass-processed.

In another exemplary embodiment, a degree of the spatial-temporal division processing may be controlled depending on the location of the edge pixel.

Figure 7:
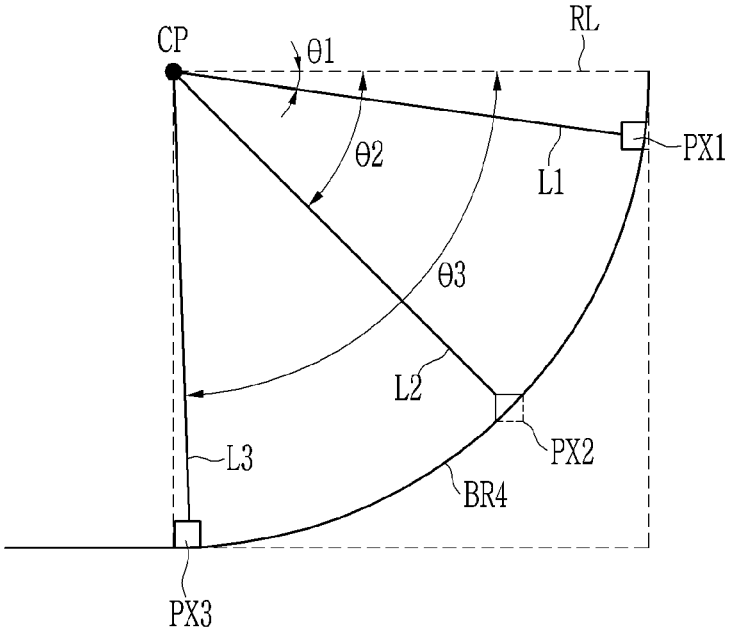
FIG. 7 is a view showing one among four edges of a rounded shape shown in FIG. 2.

FIG. 7 is a view showing one among four edges of a rounded shape shown in FIG. 2.

As shown in FIG. 7, as an angle θ between a reference line RL and a connection line connecting a virtual center point CP and an edge BR4 to the edge pixel increases, the aperture ratio difference between the red sub-pixel, the green sub-pixel, and the blue sub-pixel may be reduced in the edge pixel.

For example, a first angle θ1 formed between the reference line RL and the connection line L1 connecting the virtual center point CP and the first edge pixel PX1, a second angle θ2 formed between the reference line RL and the connection line L2 connecting the virtual center point CP and the second edge pixel PX2, and a third angle θ3 formed between the reference line RL and the connection line L3 connecting the virtual center point CP and the third edge pixel PX3 may satisfy $\theta 3>\theta 2>\theta 1$.

Figure 8A:
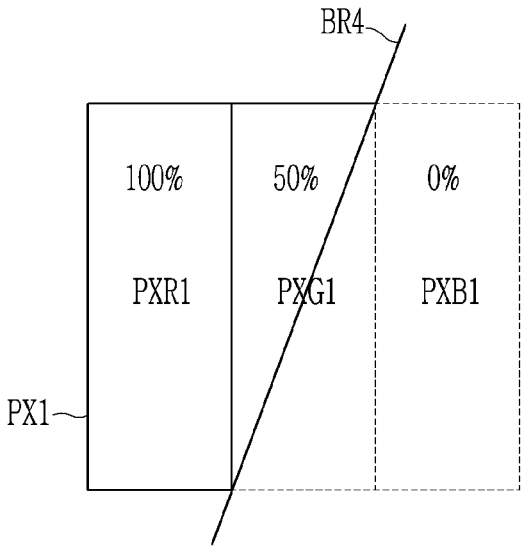
FIG. 8A, 8B and FIG. 8C are views showing an aperture ratio of sub-pixels of each of first to third edge pixels.
Figure 8B:
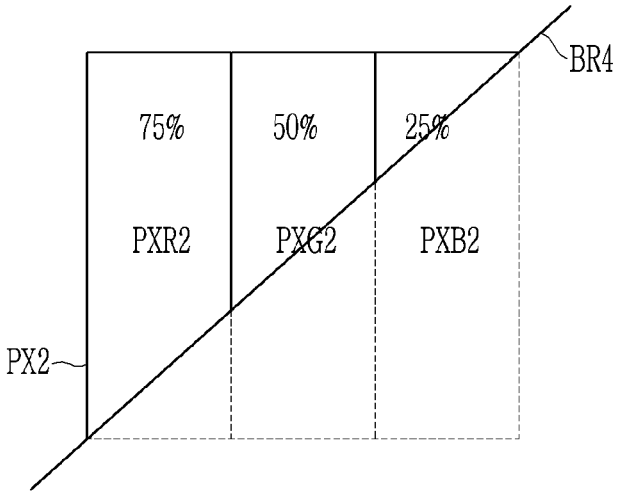
Figure 8C:
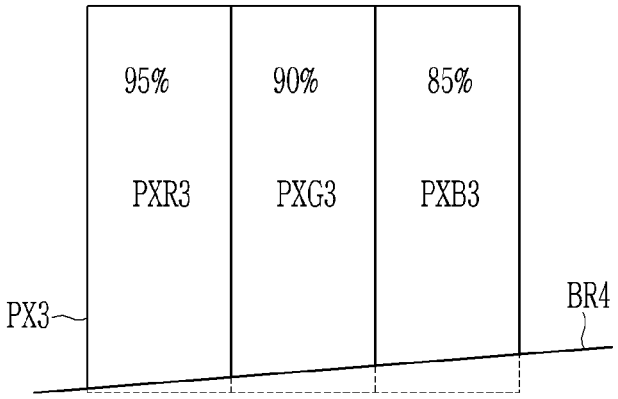

FIG. 8A to FIG. 8C are views showing an aperture ratio of sub-pixels of each of first to third edge pixels.

FIG. 8A to FIG. 8C are only examples to explain each aperture ratio of the red sub-pixel, the green sub-pixel, and the blue sub-pixel depending on the location of the edge pixel and the aperture ratio difference between the sub-pixels, however it is not limited thereto.

As shown in FIG. 8A, in the first edge pixel PX1, the aperture ratio of the red sub-pixel PXR1 is 100%, the aperture ratio of the green sub-pixel PXG1 is 50%, and the aperture ratio of the blue sub-pixel PXB1 is 0%. As a ratio of the aperture ratio between the sub-pixels is 2:1:0, the aperture ratio difference is very large.

As shown in FIG. 8B, in the second edge pixel PX2, the aperture ratio of the red sub-pixel PXR2 is 75%, the aperture ratio of the green sub-pixel PXG2 is 50%, and the aperture ratio of the blue sub-pixel PXB2 is 25%. As the ratio of the aperture ratio between the sub-pixels is 3:2:1, it is smaller than the aperture ratio difference of the first edge pixel PX1.

As shown in FIG. 8C, in the third edge pixel PX3, the aperture ratio of the red sub-pixel PXR3 is 95%, the aperture ratio of the green sub-pixel PXG3 is 90%, and the aperture ratio of the blue sub-pixel PXB3 is 85%. As the ratio of the aperture ratio between the sub-pixels is 19:18:17, it is not only smaller than the aperture ratio difference of the second edge pixel PX2, but also the difference of the aperture ratio between the sub-pixels is very small.

As described above, the aperture ratio difference between the sub-pixels is differentiates depending on the location of the edge pixel, and as the angle θ corresponding to the edge pixel increases, the aperture ratio difference between the sub-pixels is reduced.

According to another exemplary embodiment, the signal controller 130 may determine the spatial-temporal division processing degree (hereinafter, a spatial-temporal division processing ratio) depending on the positions of the pixels included in the edge region, and may process the image signal RGB depending on the determined spatial-temporal division processing ratio.

The RGB classifier 131 identifies the edge pixel of which the aperture ratio difference between the sub-pixels among the edge pixels is a threshold value or more according to the position information (ads), and bypass-processes the gray data RD, GD, and BD of the edge pixel of which the aperture ratio difference is the threshold value or more. The spatial-temporal division processing ratio may be 0%.

The RGB classifier 131 may apply the spatial-temporal division processing for the gray data RD, GD, and BD of the edge pixel of which the aperture ratio difference between the sub-pixels among the edge pixels is smaller than the threshold value according to the position information (ads). In this case, the driving controller 136 may set the spatial-temporal division processing ratio according to the location of the edge pixel, and may set the weight values WT1 and WT2 for the gray data RD, GD, and BD based on the predetermined spatial-temporal division processing ratio. The RGB classifier 131 may include a table storing whether the aperture ratio of the edge pixel is greater or smaller than the threshold value according to the position information (ads).

Also, the RGB classifier 131 may store the information for the angle θ corresponding to the position of the edge pixel according to the position information (ads), may apply the bypass processing for the gray data RD, GD, and BD of the edge pixel of which the angle θ is less than the threshold angle, and may apply the spatial-temporal division processing for the gray data RD, GD, and BD of the edge pixel of which the angle θ is more than the threshold angle. The spatial-temporal division processing ratio may increase as the angle θ increases.

For example, the RGB classifier 131 may apply the bypass processing for the gray data RD, GD, and BD of the first edge pixel PX1, and may apply the spatial-temporal division processing for the gray data RD, GD, and BD of the second edge pixel PX2 and the third edge pixel PX3. In this case, the driving controller 136 sets the weight values WT1 and WT2 for the spatial-temporal division processing of the second edge pixel PX2 based on the spatial-temporal division processing ratio according to the angle θ2. This predetermined weight values WT1 and WT2 may be set to be lower than the weight value for the pixel that is not the edge pixel.

Also, the driving controller 136 sets the weight values WT1 and WT2 for the spatial-temporal division processing of the third edge pixel PX3 based on the spatial-temporal division processing ratio according to the angle θ3. This predetermined weight values WT1 and WT2 may be set to be higher than the weight value for the second edge pixel PX2 and to be lower than the weight value for the pixel that is not the edge pixel.

Through the exemplary embodiments described, the display problem of the step shape on the non-quadrangle edge may be improved.

While this inventive concept has been described in connection with what is presently considered to be practical exemplary embodiments, it is to be understood that the inventive concept is not limited to the disclosed embodiments, but, on the contrary, is intended to cover various modifications and equivalent arrangements included within the spirit and scope of the appended claims.

What is claimed is:

1. A display device comprising:

a display panel including a display area which includes at least one non-quadrangle edge and a plurality of pixels, wherein pixels among the plurality of pixels that are not included in the at least one non-quadrangle edge are first pixels and pixels among the plurality of pixels that are included in the at least one non-quadrangle edge are second pixel; and a signal controller configured to apply spatial-temporal division processing to an image signal corresponding to each first pixels and bypass the spatial-temporal division processing to an image signal corresponding to each second pixels, wherein the spatial-temporal division processing is a data processing in which one of a high gamma value and a low gamma value is applied for the image signal.

2. The display device of claim 1, wherein the signal controller divides the image signal corresponding to the second pixel into gray data of sub-pixels configuring the second pixel.

3. The display device of claim 1, wherein the signal controller generates image data of a third pixel which is disposed adjacent to the second pixel by bypassing the spatial-temporal division processing of an image signal corresponding to the third pixel.

4. The display device of claim 1, wherein the signal controller applies the spatial-temporal division processing by using a first weight value for the image signal corresponding to the first pixels and applies the spatial-temporal division processing by using a second weight value for an image signal corresponding to a third pixel adjacent to the second pixel among the plurality of pixels, and the second weight value is smaller than the first weight value.

5. The display device of claim 1, wherein the signal controller bypasses the spatial-temporal division processing corresponding to the second pixel when an aperture ratio difference of sub-pixels configuring the second pixel is a predetermined threshold value or more and applies the spatial-temporal division processing to an image signal corresponding to a fourth pixel when the aperture ratio difference between sub-pixels configuring the fourth pixel is smaller than the threshold value.

6. The display device of claim 5, wherein a first angle formed between a reference line which is a connection line connecting a virtual center point which is a center of an arc that forms the non-quadrangle edge and the non-quadrangle edge and a connection line connecting the second pixel and the virtual center point and a second angle formed between the reference line and a connection line connecting the fourth pixel and the virtual center point are different from each other.

7. A display device comprising:

a signal controller;

a gate driver;

a data driver; and a plurality of pixels connected to the gate driver and the data driver, the plurality of pixels including;

a plurality of edge pixels disposed at an edge region included in a non-quadrangle edge of a display area; and a plurality of center pixels disposed at a location that is not included in the non-quadrangle edge on the display area, wherein the signal controller configured to apply at least one among a temporal division processing, a spatial division processing, and a spatial-temporal division processing to an image signal corresponding to each of the plurality of center pixels and configured not to apply the temporal division processing, the spatial division processing, and the spatial-temporal division processing-to an image signal corresponding to each of the plurality of edge pixels, and wherein the temporal division processing is a data processing in which one of a high gamma value and a low gamma value is applied to one frame among consecutive frames and the other of the high gamma value and the low gamma value is applied to the next frame, the spatial division processing is a data processing in which one of the high gamma value and the low gamma value is applied to one of two adjacent pixels and the other of the high gamma value and the low gamma value is applied to the other pixel, and the spatial-temporal division processing is a data processing in which one of a high gamma value and a low gamma value is applied for the image signal through the temporal division processing and the spatial division processing.

8. The display device of claim 7, wherein the signal controller configured to divide an input image signal into first to third gray data, apply spatial-temporal division processing for the first to third gray data to generate first to third correction gray data when the first to third gray data correspond to one among the plurality of center pixels, and bypass the spatial-temporal division processing for the first to third gray data when the first to third gray data correspond to one among the plurality of edge pixels.

9. The display device of claim 8, wherein the signal controller arranges the bypass-processed first to third gray data and the first to third correction gray data depending on the location of the plurality of edge pixels and the plurality of center pixels.

10. The display device of claim 8, wherein the signal controller includes:

an RGB classifier configured to receive information for a location of the plurality of pixels and determine whether or not applying the spatial-temporal division processing for the first to third gray data based on the information; and a demultiflexer to receive the first to third gray data of the plurality of center pixels from the RGB classifier and select a spatial-temporal division processing path respectively corresponding to the received first to third gray data, and generates the first to third correction gray data through the path selected by the demultiflexer.

11. The display device of claim 10, wherein the signal controller further includes:

a first gamma controller configured to multiply a weight value corresponding to the received first to third gray data to the first to third gray data received from the demultiflexer to generate compensation gray data and add the compensation gray data to the received first to third gray data to generate correction gray data; and a second gamma controller configured to multiply a weight value corresponding to the received first to third gray data to the first to third gray data received from the demultiflexer to generate compensation gray data and subtract the compensation gray data from the received first to third gray data to generate correction gray data.

12. The display device of claim 11, wherein the signal controller further includes a generator generating image data, and the demultiflexer receives the first to third gray data from the RGB classifier, the generator receives at least one among the first to third correction gray data from the first gamma controller, receives the rest among the first to third correction gray data from the second gamma controller, and generates the image data according to the location of the plurality of edge pixels based on the received first to third correction gray data.

13. The display device of claim 8, wherein the signal controller bypasses the first to third gray data corresponding to the plurality of center pixels to a generator which generates image data when the location of the plurality of center pixels among the plurality of pixels is disposed adjacent to one among the plurality of edge pixels.

14. The display device of claim 8, wherein the signal controller applies spatial-temporal division processing by using a first weight value for the first to third gray data corresponding to pixels not adjacent to the plurality of edge pixels among the plurality of pixels, and applies the spatial-temporal division processing by using a second weight value for the first to third gray data corresponding to a third pixel adjacent to an edge pixel among the plurality of pixels, and the second weight value is smaller than the first weight value.

15. The display device of claim 8, wherein the signal controller bypass-processes the first to third gray data corresponding to a first edge pixel when an aperture ratio difference between sub-pixels configuring the first edge pixel among the plurality of edge pixels is a predetermined threshold value or more, and applies the spatial-temporal division processing for the first to third gray data corresponding to a second edge pixel when the aperture ratio difference between the sub-pixels configuring the second edge pixel among the plurality of edge pixels is smaller than the threshold value.

16. The display device of claim 15, wherein a first angle formed between a reference line which is a connection line connecting a virtual center point and the non-quadrangle edge and a connection line connecting the second pixel and the virtual center point and a second angle formed between the reference line and a connection line connecting the fourth pixel and the virtual center point are different from each other.

17. A method for driving a display device comprising:

determining a location of each of a plurality of pixels corresponding to an input image signal;

setting a first weight value for spatial-temporal division processing for gray data corresponding to a plurality of first pixels when each of the location of the plurality of first pixels is not included in a non-quadrangle edge region of a display area;

generating each of first compensation gray data based on the predetermined first weight value and each of the gray data corresponding to each of the plurality of first pixels and generating each of image data based on each of the gray data corresponding to each of the plurality of first pixels and the first compensation gray data; and bypassing the spatial-temporal division processing for each of gray data of a plurality of second pixels when a location of each of the plurality of second pixels is included in the non-quadrangle edge region, wherein the spatial-temporal division processing is a data processing in which one of a high gamma value and a low gamma value is applied for an image signal.

18. The method of claim 17, further comprising bypassing the spatial-temporal division processing for the gray data corresponding to a third pixel when a location of the third pixel is adjacent to the second pixel.

19. The method of claim 17, further comprising setting a second weight value for spatial-temporal division processing for the gray data corresponding to a third pixel when a location of the third pixel is adjacent to the second pixel, and the second weight value is smaller than the first weight value.

20. The method of claim 17, further comprising:

comparing an aperture ratio difference between sub-pixels configuring the second pixel with a predetermined threshold value;

bypassing the spatial-temporal division processing for the gray data corresponding to the second pixel when the aperture ratio difference is the predetermined threshold value or more; and applying the spatial-temporal division processing for the gray data corresponding to the second pixel when the aperture ratio difference is smaller than the threshold value.

21. The method of claim 20, wherein the aperture ratio difference is changed depending on an angle between a reference line which is a connection line connecting a virtual center point which is a center of an arc that forms a non-quadrangle edge and the non-quadrangle edge and a line connecting the virtual center point and the second pixel.

* * * * *